US010588429B2

(12) United States Patent
Bates et al.

(10) Patent No.: US 10,588,429 B2
(45) Date of Patent: Mar. 17, 2020

(54) REFRIGERATED CASE WITH AN INDUCED AIRFLOW SYSTEM

(71) Applicant: Hill Phoenix, Inc., Conyers, GA (US)

(72) Inventors: Roy Bates, Colonial Heights, VA (US); Trifon Mirtchev, Colonial Heights, VA (US)

(73) Assignee: Hill Phoenix, Inc., Conyers, GA (US)

( * ) Notice: Subject to any disclaimer, the term of this patent is extended or adjusted under 35 U.S.C. 154(b) by 561 days.

(21) Appl. No.: 15/293,958

(22) Filed: Oct. 14, 2016

(65) Prior Publication Data

US 2017/0150829 A1 Jun. 1, 2017

Related U.S. Application Data

(60) Provisional application No. 62/261,035, filed on Nov. 30, 2015.

(51) Int. Cl.
*A47F 3/04* (2006.01)
*F25D 17/06* (2006.01)
(Continued)

(52) U.S. Cl.
CPC ..... *A47F 3/0447* (2013.01); *A47F 3/0408* (2013.01); *A47F 3/0469* (2013.01);
(Continued)

(58) Field of Classification Search
CPC ..... F04D 29/646; F04D 29/602; A47F 3/04; A47F 3/0443; A47F 3/0408;
(Continued)

(56) References Cited

U.S. PATENT DOCUMENTS 2,822,672 A * 2/1958 Dickson ..... A47F 3/0447 62/125
3,103,796 A * 9/1963 Dickson ..... A47F 3/0447 62/234

(Continued)

OTHER PUBLICATIONS

Moore, J. et al., Influence of the Flow from an Axial Fan on the Performance of a Heat Exchanger, Proceedings of the ASME 2011 International Mechanical Engineering Congress & Exposition, IMECE2011-62696, Nov. 11-17, 2011, Denver, CO, US, pp. 1-10.

(Continued)

*Primary Examiner* — Jorge A Pereiro
(74) *Attorney, Agent, or Firm* — Foley & Lardner LLP

(57) ABSTRACT

Systems and methods relate to a temperature-controlled case. The temperature-controlled case includes a housing that defines a temperature-controlled space and an opening for providing user access to the temperature-controlled space. The case also includes a cooling element in thermal communication with the temperature-controlled space. The case further includes a modular plenum coupled to the housing and positioned behind the cooling element relative to the opening, wherein the modular plenum includes: at least one fan removably coupled to the modular plenum, wherein the at least one fan induces an air flow through the cooling element, and at least one electrical connector coupled to the modular plenum and positioned proximate each of the at least one fan for providing electrical power to each of the at least one fan.

7 Claims, 6 Drawing Sheets

(51) Int. Cl.
*F25D 23/02* (2006.01)
*F25D 11/00* (2006.01)

(52) U.S. Cl.
CPC ..... *A47F 3/0478* (2013.01); *F25D 11/00* (2013.01); *F25D 17/06* (2013.01); *F25D 23/023* (2013.01); *A47F 3/043* (2013.01); *F25D 2317/063* (2013.01); *F25D 2317/0682* (2013.01); *F25D 2400/38* (2013.01); *F25D 2400/40* (2013.01)

(58) Field of Classification Search
CPC ..... A47F 3/0413; H05K 7/20581; G06F 1/20; F25D 2317/0681; F25D 2317/0682
See application file for complete search history.

(56) References Cited

U.S. PATENT DOCUMENTS 3,125,864 A * 3/1964 Ural ..... A47F 3/0443 62/256
3,229,475 A * 1/1966 Balk ..... A47F 3/0447 62/256
3,304,740 A * 2/1967 Balk ..... A47F 3/0447 62/256
4,271,680 A * 6/1981 Karashima ..... F25D 21/04 62/256
4,326,385 A * 4/1982 Ibrahim ..... F25D 21/125 62/256
4,369,631 A * 1/1983 Abraham ..... F25D 21/125 62/255
4,739,445 A * 4/1988 Tragen ..... H05K 7/20145 174/16.1
5,086,627 A * 2/1992 Borgen ..... A47F 3/0408 62/229
5,475,988 A * 12/1995 McGovern ..... A47F 3/0447 62/256
5,562,410 A * 10/1996 Sachs ..... F04D 29/601 361/695
6,077,037 A * 6/2000 Schmidt ..... F04D 29/601 24/546
6,244,953 B1 * 6/2001 Dugan ..... H05K 7/20172 361/695
6,272,876 B1 * 8/2001 Roberts ..... A47F 3/0482 454/193
6,360,548 B1 * 3/2002 Navarro ..... A47F 3/001 62/279
6,414,845 B2 * 7/2002 Bonet ..... H05K 7/20581 312/236
6,443,056 B1 * 9/2002 Kiefer ..... B60P 3/20 62/329
6,556,437 B1 * 4/2003 Hardin ..... H05K 7/20172 361/679.48
6,592,449 B2 * 7/2003 Cipolla ..... G06F 9/52 454/184
6,604,916 B2 * 8/2003 Lu ..... H05K 7/20581 361/695
6,791,836 B2 * 9/2004 Cipolla ..... G06F 9/52 361/679.48
6,923,013 B2 8/2005 Chiang et al.
7,259,962 B2 * 8/2007 Chen ..... G06F 1/20 361/695
7,318,321 B2 * 1/2008 Grassmuck ..... A47F 3/0447 312/116
7,505,266 B2 * 3/2009 Sanchez ..... F04D 25/0613 165/104.33
8,141,378 B2 * 3/2012 Hayase ..... A47F 3/0408 62/246
8,151,587 B2 * 4/2012 Chiang ..... A47F 3/0443 62/246
8,151,598 B2 * 4/2012 Wittern, Jr. ..... F25D 17/065 62/408
8,477,491 B1 * 7/2013 Ross ..... H05K 7/20736 361/679.48
9,307,677 B2 * 4/2016 Huang ..... H05K 7/20727
9,560,921 B2 2/2017 Resch
9,675,185 B2 6/2017 Anderson et al.
9,699,941 B2 * 7/2017 Alvarado ..... G06F 1/181
9,869,505 B2 * 1/2018 Seccuro ..... F25D 17/067
10,041,737 B2 * 8/2018 Seccuro ..... F28D 1/0477
2001/0004311 A1 * 6/2001 Negishi ..... H05K 7/20581 361/695
2002/0015648 A1 * 2/2002 Kosugi ..... F04D 25/166 417/423.14
2002/0048520 A1 * 4/2002 Lu ..... H05K 7/20581 417/360
2003/0112601 A1 * 6/2003 Smith ..... G06F 1/183 361/695
2004/0115986 A1 * 6/2004 Chen ..... F04D 29/601 439/485
2005/0249603 A1 * 11/2005 Kang ..... F04D 29/601 416/244 R
2006/0120040 A1 * 6/2006 Chen ..... G06F 1/20 361/695
2006/0120041 A1 * 6/2006 Chen ..... G06F 1/20 361/695
2006/0256522 A1 * 11/2006 Wei ..... H05K 7/20581 361/695
2006/0274498 A1 * 12/2006 Chen ..... G06F 1/20 361/679.46
2008/0043432 A1 * 2/2008 Hung ..... G06F 1/181 361/695
2009/0090734 A1 * 4/2009 Wittern, Jr. ..... F25D 17/065 221/1
2011/0255238 A1 * 10/2011 Tan ..... G06F 1/183 361/679.48
2014/0086732 A1 * 3/2014 Kelaher ..... H05K 7/20145 415/175
2014/0110088 A1 * 4/2014 Collins ..... F25D 17/067 165/121
2015/0323237 A1 * 11/2015 Kim ..... F25D 17/062 62/66
2016/0295746 A1 * 10/2016 Alvarado ..... G06F 1/181
2018/0080571 A1 * 3/2018 Yu ..... H05K 7/2019
2018/0340737 A1 * 11/2018 Seccuro ..... F28D 1/0477
2019/0073006 A1 * 3/2019 Chang ..... G06F 1/206

OTHER PUBLICATIONS

QLV7V—Reach in Eliminator Door, http://www.kysorwarren.com/files/literature/merchandisers/KW-SS-QLV7V-Eliminator-LT.pdf Feb. 23, 2012.
RHZC30 Low Temp Reach In, https://www.zero-zone.com/includes/loadFile.php?GID=100e4867be729ddebaf074550555899a, May 17, 2017.
RVLC30 Low Temp Reach Ins, https://www.zero-zone.com/includes/loadFile.php?GID=50ec1f1a137d284748c21c3283992674, Sep. 8, 2017.

* cited by examiner

REFRIGERATED CASE WITH AN INDUCED AIRFLOW SYSTEM

CROSS-REFERENCE TO RELATED APPLICATIONS

This application claims the benefit of U.S. Provisional Patent Application No. 62/261,035, filed Nov. 30, 2015, entitled "Refrigerated Case with han Induced Air Flow System," which is incorporated herein by reference in its entirety.

TECHNICAL FIELD

The present disclosure relates to a temperature controlled case. More specifically, the present disclosure relates to a temperature controlled case with an induced air flow system having a modular plenum.

BACKGROUND

It is known to provide a temperature controlled case (e.g., refrigerated case, freezer, merchandiser, etc.) for the storage, preservation, and presentation of food products (such as perishable meat, dairy, seafood, produce, etc.). Such known temperature controlled cases may include those of a type having one or more substantially horizontal support surfaces or shelves for the support and presentation of food products. Typically, one or more doors enclose the case to ensure that the food products stay refrigerated.

Often, these temperature controlled cases include cooling systems. The cooling systems may include one or more cooling elements (e.g., cooling coils, heat exchangers, evaporators, fan-coil units, etc.) through which a coolant is circulated (e.g., a liquid such as a glycol-water mixture, a refrigerant, etc.) to provide cooling to an internal cavity of the case. As a result of the cooling, the food products are typically maintained in a chilled state. These cooling systems are typically large and difficult to access if repair or maintenance work is needed. Typically, the items in the cavity must be removed prior to maintenance. More convenient and accessible systems are desired.

SUMMARY

One embodiment relates to a temperature controlled case. The temperature controlled case includes a housing that defines a temperature-controlled space and an opening for providing user access to the temperature-controlled space; a cooling element in thermal communication with the temperature-controlled space; and a modular plenum coupled to the housing and positioned behind the cooling element relative to the opening. According to one embodiment, the modular plenum includes: at least one fan removably coupled to the modular plenum, wherein the at least one fan induces an air flow through the cooling element; and at least one electrical connector coupled to the modular plenum and positioned proximate each of the at least one fan for providing electrical power to each of the at least one fan.

Another embodiment relates to a temperature controlled case having a housing defining a temperature-controlled space and a cooling element for selectively cooling the temperature-controlled space. The temperature controlled case includes at least one modular plenum coupled to the housing and positioned behind the cooling element, wherein each of the at least one modular plenum includes: a body; a bracket coupled to the body; a fan removably coupled to the bracket; and an electrical connector coupled to the body and positioned proximate the fan. The temperature controlled case may also include at least one air flow guidance device that guides an induced air flow from the cooling element to the fan.

Still another embodiment relates to method of servicing a temperature controlled case including opening only one door of the temperature controlled case; removing one plate of the temperature controlled case to provide access to a modular plenum of the temperature controlled case; and servicing a fan coupled to the modular plenum without disrupting the modular plenum or another fan coupled to the modular plenum.

DETAILED DESCRIPTION

Figure 1:
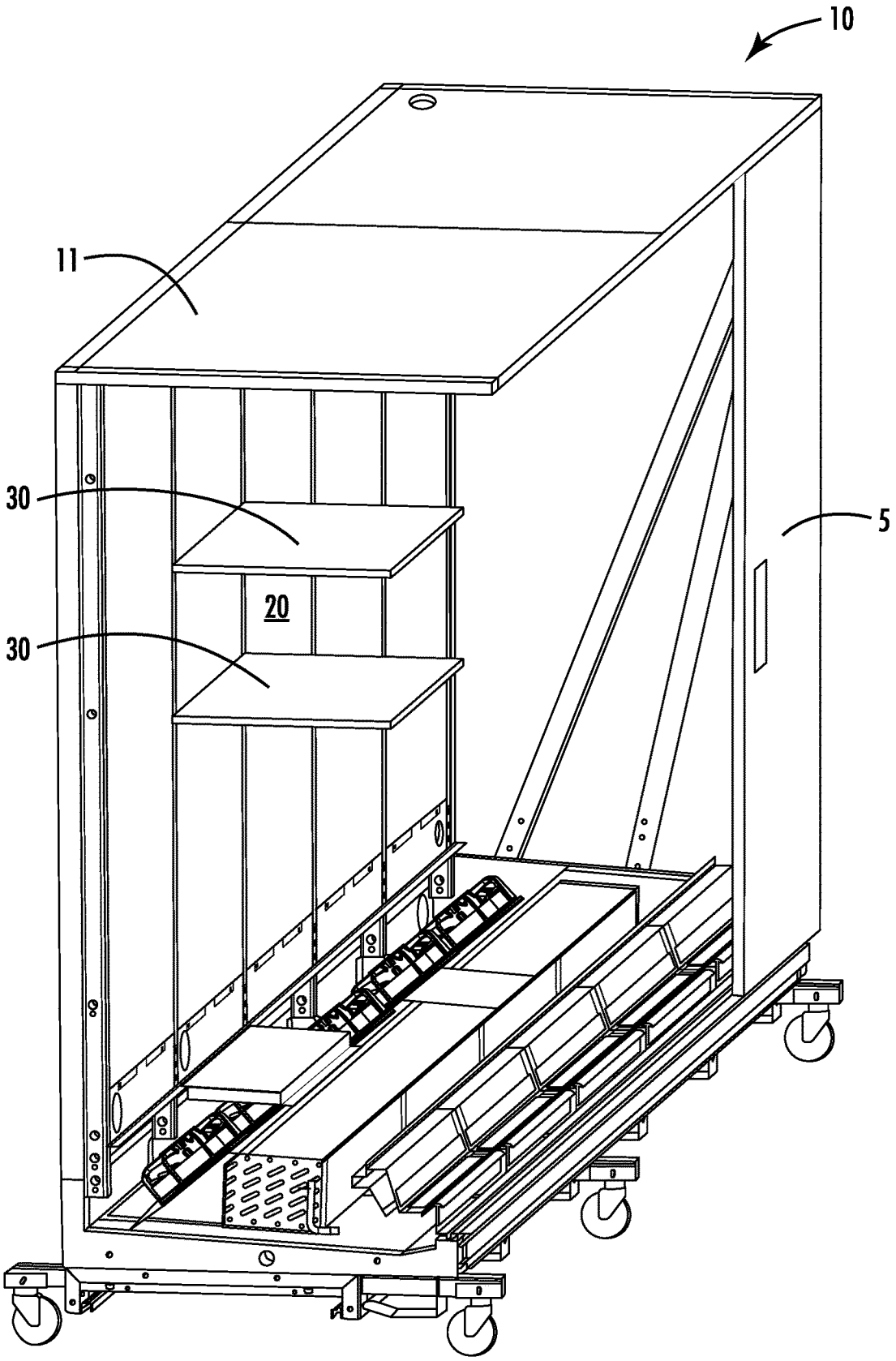
FIG. 1 is a top perspective view of a temperature-controlled case with an induced air cooling system, according to an exemplary embodiment.
Figure 2:
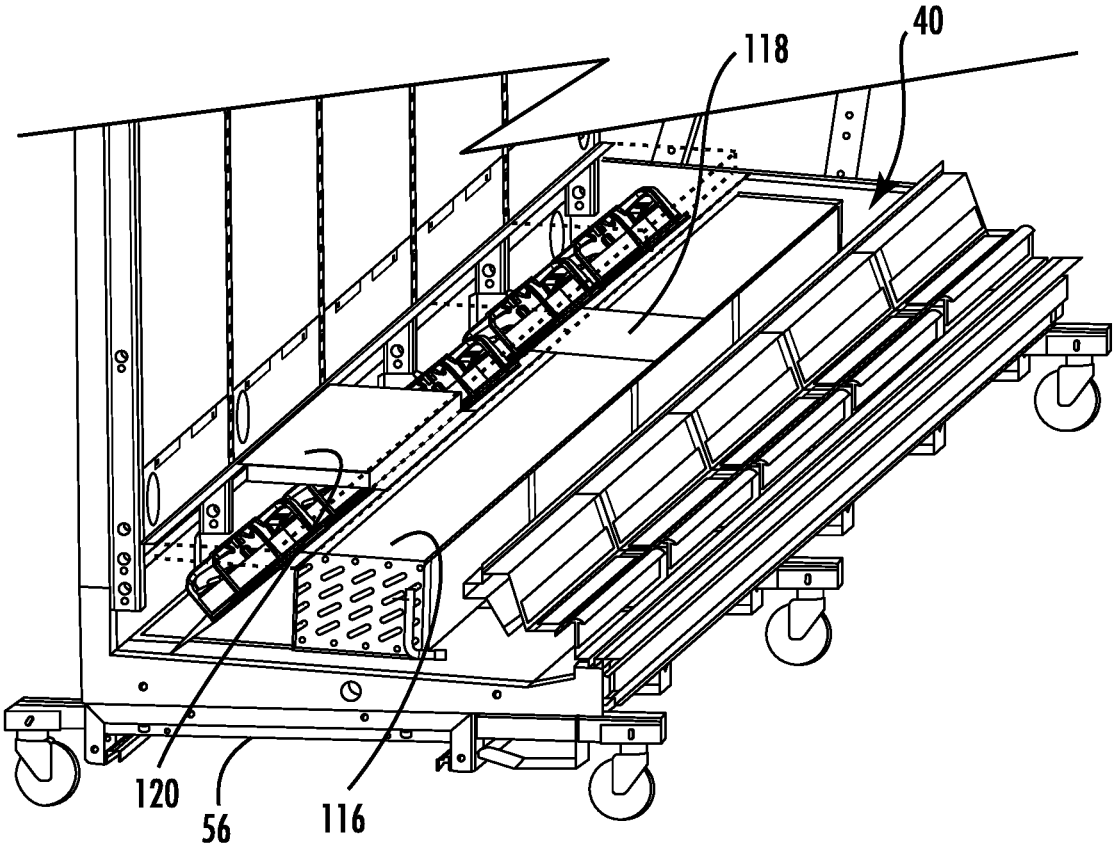
FIG. 2 is close-up perspective view of the induced air cooling system of the temperature-controlled case of FIG. 1, according to an exemplary embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to a temperature controlled case having an induced air cooling system with a modular plenum. The modular plenum may be positioned in a lower or bottom part of the housing of the case in back of the cooling element. That is to say, the modular plenum is proximate the rear of the case where the front of the case defines an opening where users may access items (e.g., food stuffs) held by the case. The modular plenum may define at least one opening for receiving an air-mover (e.g., fan). During operation, the air-mover pulls or induces an air flow through the cooling element into a rear conduit in the housing where the induced and cooled air may be circulated and provided to a discharger positioned near a back and/or front top portion of the case (i.e., proximate the opening). The discharger provides the cooled air to create an air curtain over the opening of the case. In some embodiments, the air curtain serves as the only barrier between the cooled internal environment of the case and the outside environment while in other embodiments a door may also be used in combination with or in place of the air curtain to substantially isolate the cooled interior portion from the outside environment. By utilizing an induced or pulled air flow, Applicant has determined that the discharger provides a relatively greater air discharge velocity. Beneficially, the increased velocity serves to strengthen the air curtain to thereby increase the efficacy of the barrier between the cooled interior space and the surrounding environment.

According to the present disclosure, the modular plenum may be sized and structured to accommodate the joining and disjoining of multiple modular plenums together to adapt the cooling system and temperature controlled case to any desired length. In this regard, the modular plenum may be produced in a standard size and be capable of being coupled together in an end-to-end fashion. Advantageously, a standard production part may reduce the number of parts used in the assembly and manufacture of temperature-controlled cases, which may reduce inventory costs and increase production efficiency.

As mentioned above and in one embodiment, the modular plenum is positioned behind the cooling element (i.e., towards the rear of the case) to facilitate the induced air flow caused by the air-movers held by the plenum. According to one embodiment, the modular plenum is coupled to a base of the case and positioned at an angle relative to the base (more generally, a horizontal plane). By angling the plenum, the air mover is relatively more aligned with the rear conduit in the rear of the housing to reduce impediments to the induced air flow into the conduit and, eventually, the discharger. Further, by positioning the modular plenum behind the cooling element and providing the air mover at a position that is relatively more in line with the rear conduit, several benefits can be realized. For example, the air mover may pull relatively more air into the rear conduit (e.g., cubic feet per minute) to, in turn, lower the air mover speed (thus lower energy). Applicant has also determined that the induced air flow creates a relatively more uniform air flow across the cooling element, which results in more heat transfer with less mass flow and better efficiency. Consequently, the induced air flow may allow longer operational durations before a defrost cycle may be needed.

Structurally, the induced air cooling system may also provide more space proximate the front of the case because the air mover(s) are positioned in the rear of the case. This arrangement may provide space for piping and other components in the front of the case. Moreover, the temperature-controlled case may be easier to clean since the cooling element is exposed and can be hosed down easily without having to move a plenum. Further, accumulated water or condensation may drain relatively easier because the condensation is not impeded by any plenum surfaces due to the modular plenum being positioned in the rear of the cooling element. Additionally, a tank heater that may be traditionally used to prevent the freezing of condensation to facilitate drainage of accumulated condensation may be removed because the cooling element may be positioned relatively closer to the drain such that the entire area may be maintained at a temperature sufficient to substantially prevent the condensation from freezing before the condensation reaches the drain. These and other features and benefits are described more fully herein.

Referring now to FIGS. 1-4, a temperature-controlled display device 10 is shown, according to an exemplary embodiment. The temperature controlled-display device 10, also referred to as a temperature controlled case, may be a refrigerator, a freezer, a refrigerated merchandiser, a refrigerated display case, or other device capable of use in a commercial, institutional, or residential setting for storing and/or displaying refrigerated or frozen objects. For example, the temperature-controlled display device 10 may be a service type refrigerated display case for displaying fresh food products (e.g., beef, pork, poultry, fish, etc.) in a supermarket or other commercial setting.

The temperature-controlled display device 10 is shown to include a temperature-controlled space 20 (i.e., a display area) having a plurality of shelves 30 for storage and display of products therein. In various embodiments, the temperature-controlled display device 10 may be an open-front refrigerated display case (as shown in FIGS. 1-4) or a closed-front display case. An open-front display case may use a flow of chilled air that is discharged across the open front of the case (e.g., forming an air curtain 18) to help maintain a desired temperature within temperature-controlled space 20. A closed-front display case may include one or more doors (such as door 5 shown in FIG. 1) for accessing food products or other items stored within temperature-controlled space 20. The one or more doors may be movable from a closed position to an open position. In the closed position, the door covers or substantially covers an opening of the case 10 to prevent user access to the temperature-controlled space 20. In the open or partial open position, the door is positioned a distance away from the opening to provide user access to the space 20 via the opening. In this regard, the temperature-controlled case 10 of FIG. 1 shows only one door 5 for clarity to show the inner components of the case 10. It should be understood that both types of display cases may also include various openings within temperature-controlled space 20 that are configured to route chilled air from a cooling element 110 to other portions of the respective display case (e.g., via fan 156).

Figure 3:
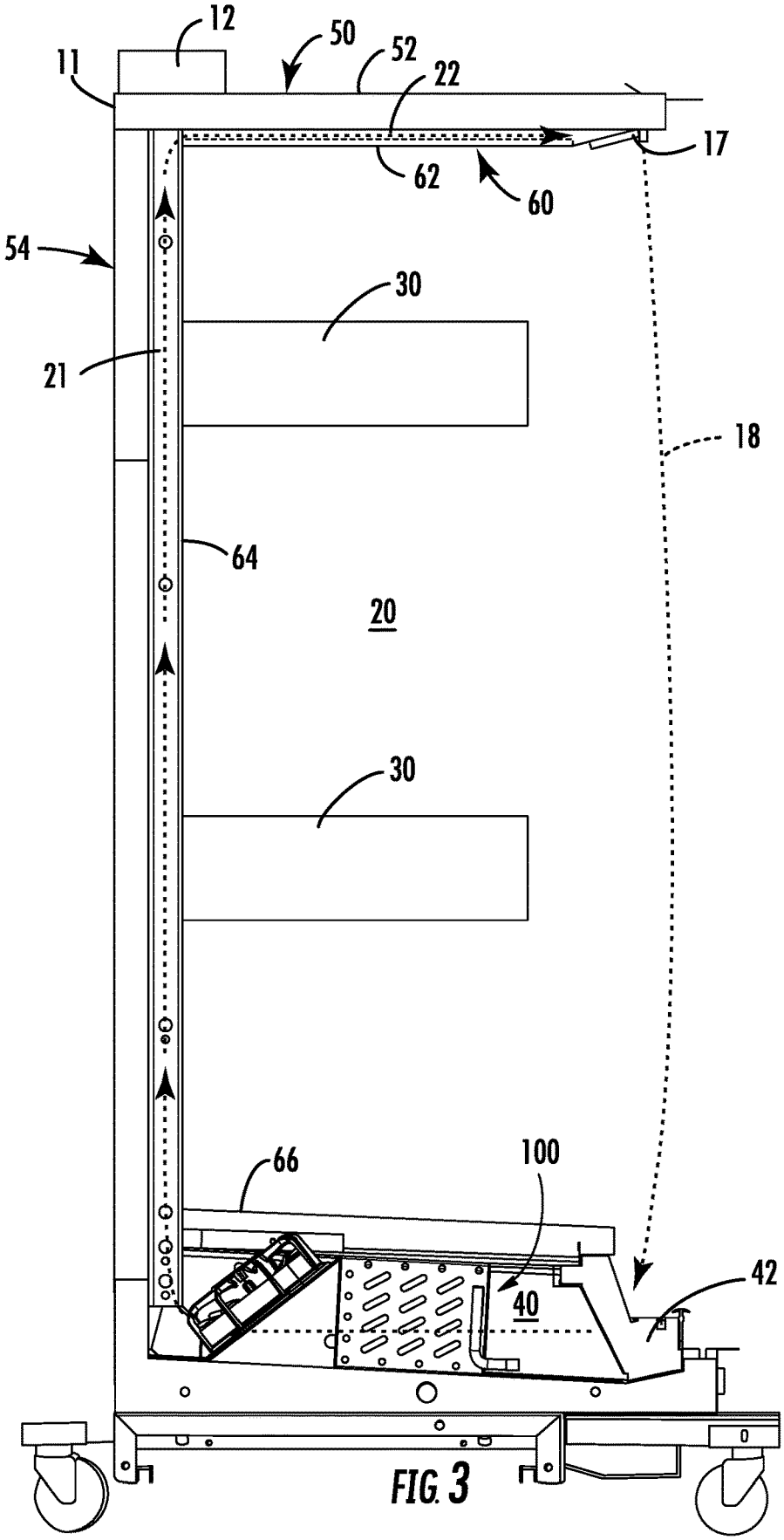
FIG. 3 is side plan view of the temperature-controlled case of FIGS. 1-2, according to an exemplary embodiment.
Figure 4:
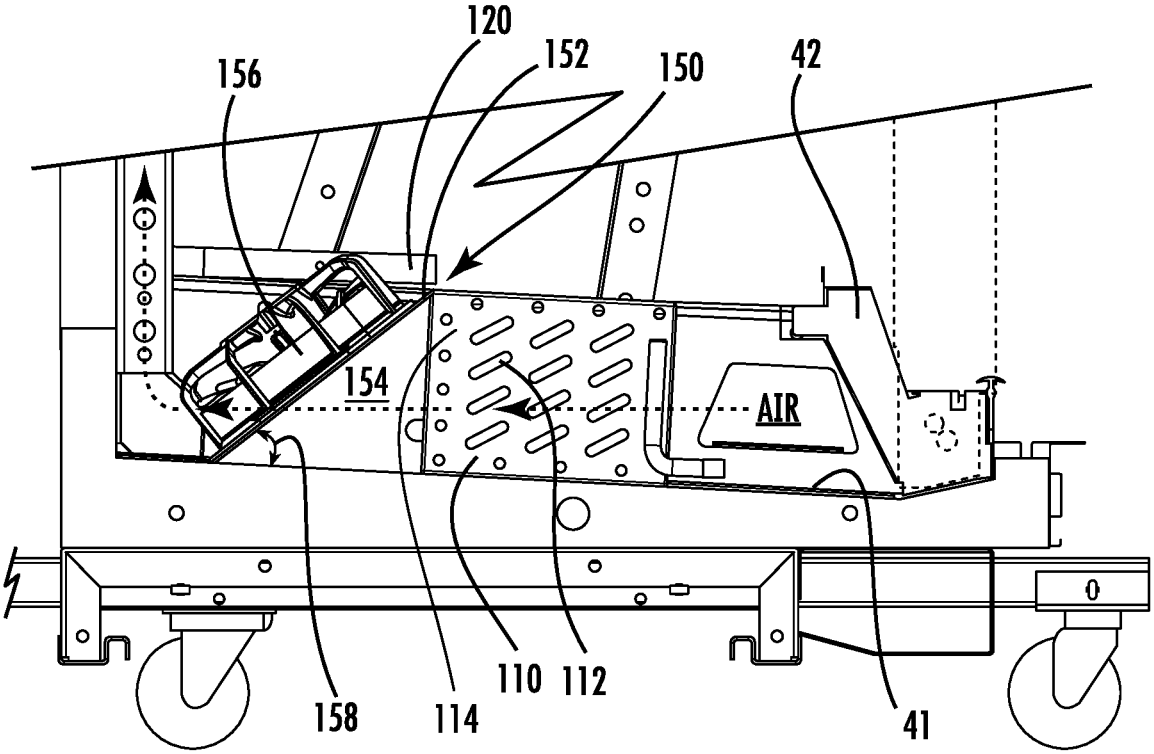
FIG. 4 is a close-up view of the induced air cooling system of FIGS. 1-3, according to an exemplary embodiment.

The temperature-controlled display device 10 may include a cooling system 100 for cooling temperature-controlled space 20 (see FIGS. 3-4). The cooling system 100 may be configured as a direct expansion system or a secondary coolant exchange system. All such variations are intended to fall within the spirit and scope of the present disclosure. The cooling system 100 includes at least one cooling element 110 that includes heat exchange fins 114 coupled to a cooling coil 112 (e.g., an evaporator coil, etc.) to form a fin-coil or fan-coil unit. In the cooling mode of operation, the cooling element 110 may operate at a temperature lower than 32 degrees Fahrenheit to provide cooling to the temperature-controlled space 20. As the heat is removed from the air circulating the space 20, the air is chilled. The chilled air may then be directed to temperature-controlled space 20 by at least one fan 156 (or another air flow or air moving device) in order to lower or otherwise control the temperature of temperature-controlled space 20.

The temperature-controlled display device 10 is shown to further include a compartment 40 located beneath the temperature-controlled space 20. In various embodiments, the compartment 40 may be located beneath the temperature-controlled space 20 (as shown), behind the temperature-controlled space 20, above the temperature-controlled space 20, or otherwise located with respect to the temperature-controlled space 20. All such variations are intended to fall within the spirit and scope of the present disclosure. The compartment 40 may contain components of the cooling system 100, such as a condensing unit. In some embodiments, the cooling system 100 includes one or more additional components such as a separate compressor, an expansion device such as a valve or other pressure-regulating device, a temperature sensor, a controller, a fan, and/or other components commonly used in refrigeration systems, any of which may be stored within compartment 40.

As shown, the temperature controlled display device 10 may also include a box 12 for electronics (i.e., an electronics box). The electronics box 12 may be structured as a junction box for one or more electrically-driven components of the device 10 (e.g., fan 156). The electronics box 12 may also be structured to store one or more controllers for one or more components of the device 10. For example, the box 12 may include hardware and/or logic components for selectively activating the cooling system 100 to achieve or substantially achieve a desired temperature in the display area 20.

As also shown, the temperature-controlled display device 10 includes a housing 11. The housing 11 includes cabinets (e.g., shells, etc.) shown as an outer cabinet 50 and an inner cabinet 60 that include one or more walls (e.g., panel, partition, barrier, etc.). The outer cabinet 50 includes a top wall 52 coupled to a rear wall 54 that is coupled to a lower base wall 56. The inner cabinet 60 includes a top wall 62 coupled to a rear wall 64 that is coupled to a base wall 66. Coupling between the walls may be via any type of attachment mechanism including, but not limited to, fasteners (e.g., screws, nails, etc.), brazes, welds, press fits, snap engagements, etc. In some embodiments, the inner and outer cabinets 60 and 50 may each be of an integral or uniform construction (e.g., molded pieces). In still further embodiments, more walls, partitions, dividers, and the like may be included with at least one of the inner and outer cabinets 60 and 50. All such construction variations are intended to fall within the spirit and scope of the present disclosure.

The temperature controlled display device 10 may define one or more ducts (e.g., channels, pipes, conduits, etc.) for circulating chilled air from the cooling system 100. As shown, the outer rear wall 54 and inner rear wall define or form a rear duct 21. The rear duct 21 is in fluid communication with the compartment 40. The rear duct 21 is also in fluid communication with a top duct 22. The top duct 22 is defined or formed by the outer top wall 52 and the inner top wall 62. While shown as primarily rectangular in shape, it should be understood that any shape and size of the ducts may be used with the temperature controlled display device 10 of the present disclosure. Furthermore, in some embodiments, at least one of the rear and top ducts 21, 22 may include one or more openings (e.g., apertures) in communication with the display area 20. When chilled air is circulated through the ducts, a portion of the chilled air may leak out of the openings into the display area 20 for additional cooling.

Operation of the ducts 21 and 22 in connection with the cooling system 100 of the temperature-controlled display device 10 may be described as follows. As heat is removed from the surrounding air via the cooling element 110, the surrounding air is chilled. While the chilled air may be directed to temperature controlled space 20 by at least one air mover or another air flow device, the chilled air may also be circulated through the ducts 21 and 22 by the fan 156. Via the motive force from the fan 156, the chilled air is first directed to the rear duct 21. The rear duct 21 guides the chilled air to the top duct 22. The top duct 22 guides the chilled air to the discharger 17 (e.g., diffuser, etc.) that discharges the chilled air to form or at least partially form the air curtain 18. At least part of the air in the air curtain 18 is received by a receptacle, shown as a vent 42 that is in fluid communication with the compartment 40. The received air may then be pulled through the cooling element by the fan 156 and the process repeated.

According to the present disclosure, the cooling system 100 includes a modular plenum 150 (e.g., modular plenum segment, modular plenum panel, etc.) coupled to the housing 11 (e.g., an inner base wall 41 of the compartment 40 proximate the outer base wall 56). As shown, the modular plenum 150 is in fluid communication with the cooling element 110 and is positioned behind or in the rear of the cooling element 110 (i.e., proximate the rear wall 64).

The modular plenum 150 may be of unitary construction or comprise two or more components coupled together. As shown, the modular plenum 150 includes a body 152 that is positioned at an angle 158 with respect to the lower base wall 41 of the compartment 40. The angle 158 is highly configurable and may vary based on spaced constraints in the compartment 40. According to one embodiment, the angle 158 is related to the position of the rear duct 21. Particularly, the angle 158 may be selected to facilitate guidance of chilled air into the rear duct 21. Advantageously, the chilled air is then induced at a higher efficiency into the duct 21. That is to say and as compared to "pushed air configurations" where the fan is placed in front of the cooling element, the combination of positioning the fan 156 behind cooling element 110 and at an angle 158 relative to the rear duct 21 enables a relatively better guidance of the chilled air into the duct 21. As a result, Applicant has determined that a relatively greater velocity of the chilled air out of the discharger 17 may be achieved. In turn, the fan(s) 156 may be operated at a relatively lower energy consumption setting, which may reduce operation costs of the cooling system 100.

Moreover, by positioning the fan 156 at the angle 158 and therefore away from the rear 64, static pressure across the cooling element 110 may be reduced. As a result, air flow through the cooling element 110 induced by the fan 156 is relatively more uniform and constant. The steady air flow through the cooling element 110 reduces static pressure to reduce the accumulation of frost in and around the cooling element 110. As a result, the number of defrost cycles used with the cooling system 100 of the present disclosure may be reduced. Consequently, operational costs may be reduced as well as downtime caused by operation of the defrost cycles.

According to one embodiment, modular plenum 150 is positioned at the angle to define an approximate 2.00-3.00 inch gap between the blades of the fan 156 and the rear wall 64. In this case, approximate refers to +/−0.1 inches. In another embodiment, the modular plenum 150 may be positioned a different distance away from the rear wall 64 (e.g., greater than or less than 2.00-3.00 inches).

As shown, the modular plenum 150 and cooling element 110 may include one or more airflow guidance devices that define a desired flow path for the air received by the vent 42 and guided through the compartment 40 into the ducts. Particularly, the modular plenum 150 is shown to include a side panel 154. The side panel 154 may have any shape to correspond with the angle 158 defined by the body 152 relative to the base wall 41. In one embodiment, the side panel 154 is coupled to the body 152 via one or more fasteners or other joining processes (e.g., welds). In another embodiment, the side panel 154 and body 152 are of unitary construction (e.g., a one-piece component). The side panel 154 prevents or substantially prevents air pulled through the cooling element 110 from escaping or leaking out prior to being induced by the fan 156 into the rear duct 21. Similarly, the cooling element 110 is shown to include a cover 116 (e.g., shroud, panel, etc.) coupled to a top portion of the cooling element 110 (e.g., to an upper surface of the fins 114). The cover 116 is positioned above the cooling element 110 (e.g., proximate the base wall 66) to prevent or substantially prevent the air passing through the cooling element 110 from moving upwards and away from the desired flow path to the fan 156 (and, consequently the ducts 21, 22). In this regard, between the end fins 114 on the cooling element and the cover 116, induced air is substantially only allowed to travel through the cooling element 110 to the fans 156.

As also shown, a plate 120 is coupled to the rear wall 64 of the case 10. The plate 120 (e.g., shroud, cover, etc.) is positioned above the modular plenum 150 and may also be coupled to the cooling element 110 (e.g., via one or more fasteners, an interference fit, a snap engagement, etc.). The plate 120 prevents or substantially prevents induced air from the fan 156 from traveling up and away from the rear duct 21. Accordingly, the combination of the plate 120, side panel(s) 154, and cover 116 guide the induced air into the rear duct 21 to substantially prevent chilled air from escaping. According to one embodiment, one plate 120 is used to shield or cover one fan 156 held by the plenum 150. In this regard, if only one fan 156 is desired to be serviced, then only the one corresponding plate 120 needs to be removed. Because the plate 120 does not extend the length of the case 10, the relatively smaller and modular plate 120 may be easier to handle and manipulate by personnel servicing or maintaining the case 10. In another embodiment, the plate 120 may be any length desired.

The modular plenum 150, side panel(s) 154, cover 116, and plate 120 may be constructed from any suitable materials for providing structural rigidity to hold the fans 156 (i.e., the modular plenum 150) and for serving as an airflow guidance device (i.e., the side panel(s) 154, cover 116, and plate 120). In one embodiment, each of the modular plenum 150, side panel(s) 154, cover 116, and plate 120 are constructed from a metal-based material (e.g., sheet metal). In another embodiment, one or more of the modular plenum 150, side panel(s) 154, cover 116, and plate 120 are constructed from a composite-based material (e.g., plastic, etc.). In still another embodiment, one or more of the modular plenum 150, side panel(s) 154, cover 116, and plate 120 are constructed from any combination of metal-based and composite-based materials.

As shown in FIGS. 3-4, a relatively large volume is defined in the compartment 40 between the cooling element 110 and the vent 42 (as compared to a conventional cooling system with the fan placed in front of the cooling element). The relatively large volume may facilitate reception of piping (e.g., to transport coolant between a condensing unit and the cooling element) and any other components of the cooling system 100 and the case 10. Further, the relatively large volume removes impediments, such as fans, to facilitate condensation to reach a frontward positioned drain. Beneficially, such a structural arrangement facilitates efficient condensation management to maintain a relatively clean compartment 40 to, in turn, reduce the frequency of defrost cycles to remove the condensation and need for service personnel to clean the compartment 40.

Figure 5A:
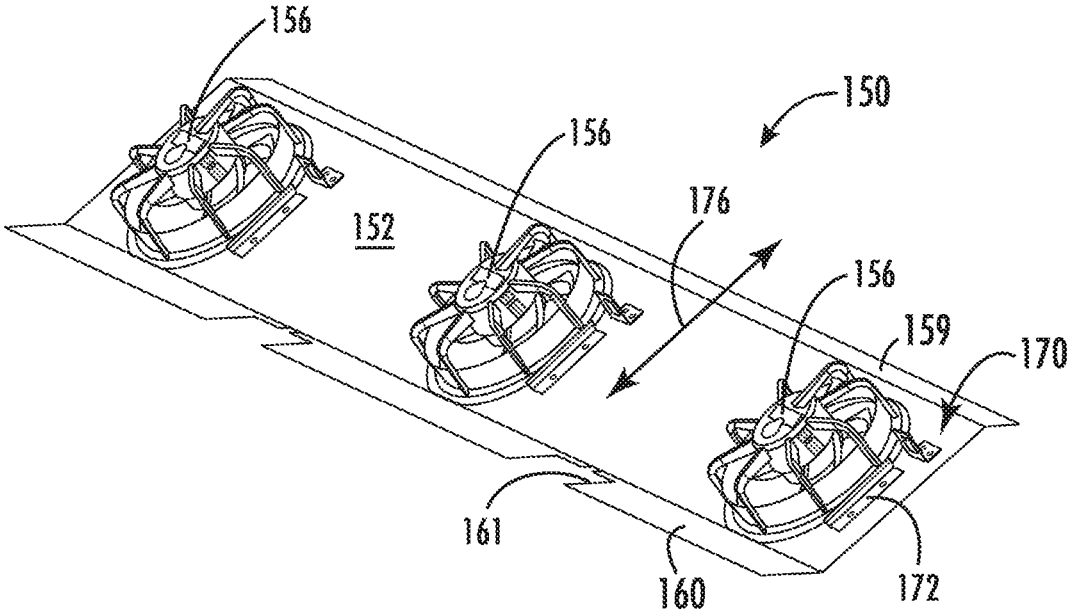
FIGS. 5A-5B are perspective view (FIG. 5A) and rear plan view (FIG. 5B) images of a modular plenum for a temperature-controlled case, according to exemplary embodiments.
Figure 5B:
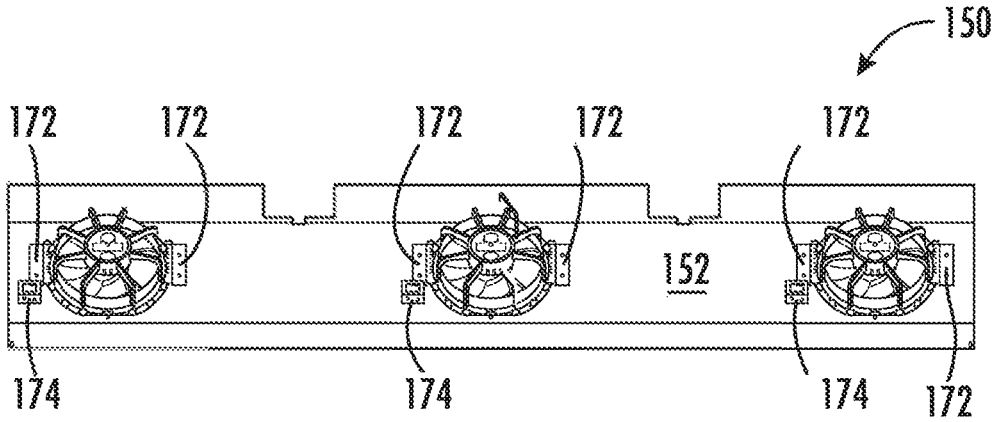

Referring now to FIGS. 5A-5B, perspective view (FIG. 5A) and a front view (FIG. 5B) of the modular plenum 150 is shown according to various exemplary embodiments. In the example depicted, the modular plenum 150 is designed for a three-door temperature-controlled case, where each of the three fans 156 depicted correspond with a door section of the three-door case. According to one embodiment, the modular plenum 150 is produced in a two-door variation (i.e., two fans 156) and a three-door variation. Such production allows a variety of lengths to be constructed for a variety of cases (i.e., five-door cases, eight door cases, etc.). Of course, in other embodiments, the modular plenum 150 length arrangement may be different than depicted and described above. For example, another variation of a standard construction may be a one-fan plenum 150. In this configuration, an assembler may conveniently join one-fan plenums together to make any desired length. In another example, one fan may be used with more than one door section of the case (e.g., one-fan per two doors). Thus, as one of ordinary skill in the art will appreciated, the depicted construction is only one methodology as many other methodologies may be used with all such methodologies intended to fall within the spirit and scope of the present disclosure.

As shown in FIGS. 5A-5B, the body 152 of the modular plenum 150 is of integral or unitary construction and includes an upper or top flange 159 (e.g., top panel, top section, top plate, etc.) and a lower or bottom flange 160 (e.g., bottom panel, bottom section, bottom plate, etc.). In use, the top flange 159 is proximate the cover 116 of the cooling element 110 while the bottom flange 160 is proximate the base wall 41 of the compartment 40. In one embodiment, the top flange 159 may be coupled to at least one of the cooling element 110 and the cover 116. Beneficially, such construction creates an overlap between the modular plenum 150 and the cooling element 110 to prevent or substantially prevent the likelihood of induced air from escaping as the induced air moves through the cooling element 110 towards the fans 156. In another embodiment, the top flange 159 is not coupled to at least one of the cooling element 110 and cover 116; rather, the top flange 159 may be positioned in proximity to the cover 116 and/or cooling element 110 to still achieve or substantially achieve an air guiding structure.

In comparison, the bottom flange 160 may be fixedly coupled to the bottom wall 41 of the compartment 40 and proximate the rear wall 64. Coupling of the bottom flange 160 to the bottom wall 41 supports the body 152 of the modular plenum 150 at the desired angle 158. In some embodiments, one or more of the side panels 154 may also be coupled to the bottom wall 41 to provide additional support to the plenum 150 as well as providing a seal for the induced air flow. According to an alternate embodiment, the modular plenum 150 may be of integral construction with the bottom wall 41. All such variations are intended to fall within the scope of the present disclosure.

The bottom flange 160 is shown to define a plurality of openings 161 (e.g., voids, gaps, apertures, etc.). The openings 161 may be sized to mate, engage with, or interface with one or more support structures in the case 10 (e.g., a vertically-extending rib that stretches substantially a length of the of the rear wall 64). In another embodiment, the bottom flange 160 may exclude the openings 161.

According to various other embodiments, rather than being of unitary construction, at least one of the top flange 159 and the bottom flange 160 may be coupled to the body 152 of the modular plenum 150. For example, at least one of the top flange 159 and the bottom flange 160 may be welded to the body 152. Further, while the top flange 159 and the bottom flange 160 are shown to be substantially rectangular in shape, this depiction is for exemplary purposes only, such that other shapes may be utilized. In this regard and according to an alternate embodiment, the modular plenum 150 may exclude at least one of the top and bottom flanges 159, 160.

The modular plenum 150 also includes a fan coupling system 170 for each fan 156. That is to say, the modular plenum 150 utilizes a fan coupling system 170 for each fan 156 to couple each fan 156 to the plenum 150. The fan coupling system 170 includes a pair of brackets 172 coupled to the body 152 and an electrical connector 174 coupled to the body 152. The pair of brackets 172 may be coupled to the body 152 in any manner (e.g., welds, fasteners, brazing, etc.). Per fan 156, each bracket in the pair of brackets 172 is positioned substantially parallel to each other. Beneficially, this positioning creates an opening or receptacle between the pair of brackets 172. Accordingly, in use, the fan 156 may slide in along a path 176 that is substantially parallel with the angle 158 within the pair brackets 172 to engage and disengage with the pair of brackets 172. One or both of the brackets 172 may create a lock (e.g., a snap engagement) with the fan 156 to securely hold or couple the fan 156 to the plenum 150. In another embodiment, a fastener, such as a set screw, may be used to hold the fan 156 in the pair brackets 172. In still another embodiment, the fan 156 may only slid in and out of a pair of brackets 172 without the use of any type of lock mechanism.

As mentioned above, the fan coupling system 170 also includes an electrical connector 174 coupled to the body 152 and positioned proximate the fan 156 when the fan 156 is inserted or received in the pair of brackets 172. The electrical connector 174 (e.g., socket, outlet, etc.) may be electrically coupled to the box 12, such that electrically coupling a plug (not shown) of the fan 156 with the connector 174 allows the box 12 to selectively power the fan 156. Due to the proximity of the electrical connector 174 relative to the fan 156, intricate piping and wiring may be avoided when providing electrical power to the fan 156. Such construction reduces space requirements and improves install efficiency.

With the above in mind and with references to FIGS. 1-5B, assembly of the modular plenum 150 for use in the case 10 may be described as follows. Before or after attachment of the cooling element 110 to the case 10, the modular plenum 150 may be attached to the case 10 in the rear or back of the cooling element 110 (i.e., proximate the rear wall 64). During installation, electrical power may be routed to and attached to the plenum 150 to provide power to one or more of the connectors 174 of the plenum 150. Depending on the size of the case 10 and in the example depicted in FIG. 1 (a five-door case with five fans 156, where one of the fans is shielded or covered by a plate 120), a three-fan plenum is coupled to or joined with a two-door fan plenum. A coupler 118 (e.g., coupling plate, joining mechanism, etc.) may be used to couple adjacent modular plenums 150 together. As shown in FIG. 1, the coupler 118 is also coupled to at least one of the cooling element 110 and the cover 116. Thus, the coupler 118 (e.g., coupler plate, coupler section, coupling section, etc.) may fixedly join two plenums together and to the cooling element 110. As will be appreciated, many couplers 118 may be used to accommodate temperature-controlled cases of various sizes. For example, a ten-door case may utilize two three-fan plenums and two two-fan plenums. As a result, three couplers 118 may be used to couple the four modular plenums together. In addition to the side panel(s) 154, cover 116, and plate 120, the coupler 118 may be used to shield or substantially shield the air flow path in the compartment 40 to guide or route the chilled air into the ducts and prevent leakage. Accordingly, the coupler 118 may be constructed from the same or similar materials as described above in regard to the modular plenum 150, side panel(s) 154, cover 116, and plate 120.

Referring still to FIGS. 1-5B, after or before installation of the coupler 118, the fans 156 may be coupled to the plenum 150. To couple the fan 156 to the plenum 150, the fan 156 is slid into a pair of brackets 172, where the pair of brackets 172 substantially securely hold the fan 156 to the plenum 150. Subsequently, an electrical plug of the fan 156 is inserted into the connector 174. Finally, the plates 120 are installed to shield the fans 156 and substantially cover the gap defined between the fan 156 and the rear wall 64. At this point, operation of the induced air cooling system 100 may be implemented to cool the space 20 of the case 10.

Figure 6:
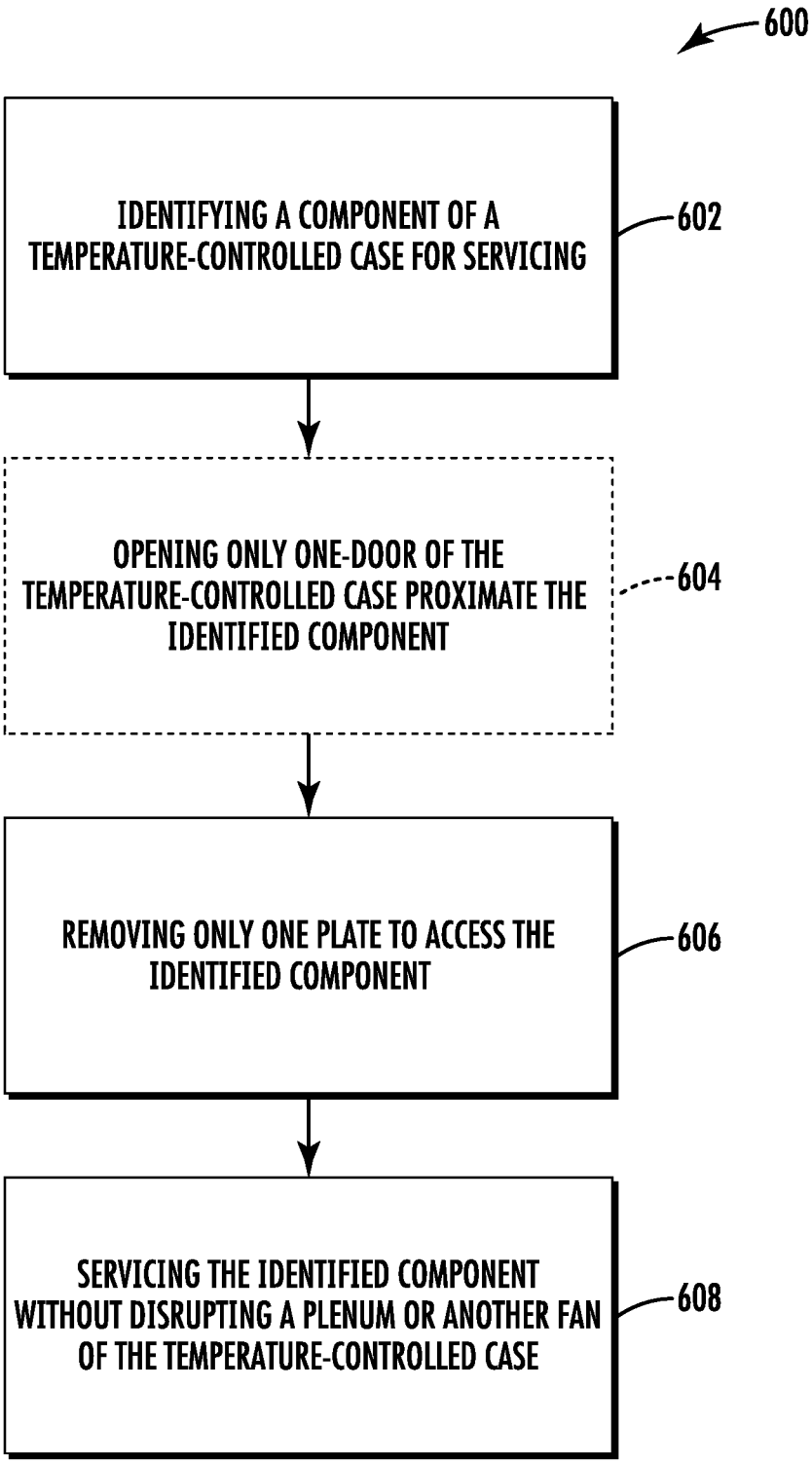
FIG. 6 is a flow diagram of a method of servicing a temperature-controlled case, according to an exemplary embodiment.

Referring now to FIG. 6, a method of servicing a temperature-controlled case is shown according to an exemplar embodiment. According to one embodiment, method 600 may be used with the modular plenum 150 of the temperature-controlled case 10 of FIGS. 1-5B, such that reference to FIGS. 1-5B may be made in explaining method 600.

At step 602, a component of a temperature-controlled case for servicing is identified. Identification may be via a signal communicated from the box 12 to a remote monitoring device, an indication provided on the case itself, and/or via any other way to facilitate identification of components of a temperature-controlled case for servicing by the relevant personnel (e.g., a technician, etc.). According to one embodiment, the component is any component included with the modular plenum 150. Accordingly, the component may include, but is not limited to, one or both of the pair of brackets 172, an electrical connector 174, and a fan 156.

At step 604, only one-door of the temperature-controlled case is at least partly opened, where the door at least partly opened is proximate the identified component (e.g., door 5 of FIG. 1). Step 604 may be an optional step because method 600 may be implemented with a temperature-controlled case that excludes door(s). A door-less temperature-controlled case may utilize another barrier-providing device, such as an air-curtain, or may exclude the use of such barrier-providing devices entirely.

Between steps 604 and 606, one or more items in the section of the case proximate the identified component may be removed. According to one embodiment, only items (e.g., food stuffs, beverages, etc.) near the bottom of the case (e.g., on the bottom of the case and the first shelf above the bottom of the case) are removed. Removing the items in this section facilitates access to the identified component.

At step 606, only one plate is removed to provide access to the identified component. As mentioned above, the plate 120 may be coupled to at least one of the cooling element 110, plenum 150, and rear wall 64 via one or more fasteners (e.g., screws) or another coupling mechanism (e.g., a snap engagement, a slide engagement, etc.). Further, the plate 120 may be sized to substantially only shield or cover one fan 156 of each plenum 150 included with the case 10. Accordingly, removal of the plate 120 provides access to one fan 156 and the fan coupling system 170 for that one fan 156 of the plenum 150.

At step 608, the identified component is serviced, where servicing is accomplished without disrupting the plenum or another fan of the temperature-controlled case. For example, when the component is a fan 156, the fan 156 may be unplugged and slid-out from the pair of brackets 172. At which point, a replacement fan 156 may be slide into the pair of brackets 172 and electrically connected to the connector 174. The plate 120 may be re-attached and the case 10 ready for use again. Advantageously, during this replacement process, other fans and components of the modular plenum 150 are not disrupted. Further, items in the case proximate the other fans and components are also not disrupted. Accordingly, relevant personnel may quickly access and service the identified component with minimal impact/disruption on the non-serviced portion of the case.

An example of method 600 may be described as follows. A fan is identified to be serviced (e.g., replaced, checked, monitored, fixed, etc.). The items in the case proximate the identified fan are removed. Beneficially, the items held in the remainder of the case need not be cleared to access the identified fan. Such ease of access may reduce downtime of use of the case. The plate proximate the identified fan is then removed, which provides visual access of the identified fan. At which point, the technician, service-person, or other relevant personnel may then examine the identified fan. If the fan is determined to be replaced, the relevant personnel may electrically disconnect the identified fan from the connector of the plenum and slidably remove the fan from the brackets (i.e., brackets 172). This may entail relieving a locking mechanism, such as a set screw, or simply sliding the fan out from the brackets along the path 176. Subsequently, the personnel may slide the replacement fan into the brackets and attach an electrical connector of the replacement fan with the electrical connector of the plenum. The personnel may then re-attach the plate and the temperature-controlled case is ready for use.

Advantageously, personnel need not remove several components to access the fan (or other identified component). Further, personnel do not need to disrupt operation of the other fans attached to the plenum. In turn, the items proximate the other fans need not be removed and stored in other chilled locations. Thus, personnel can perform dedicated or isolated servicing, which alleviates the need to take a part of the case in order to access components of the plenum.

Moreover, placement of the electrical connector 174 proximate the pair of brackets 172 provides a "plug-in play" feature to the case of the present disclosure. This plug-in play feature or quick-connect feature allows the quick connecting/disconnecting of fans for servicing and replacement. Further, the plug-in play feature is also applicable with the modular plenum 150 itself, where one or more modular plenums 150 may be easily coupled and decoupled from the case (e.g., via the bottom flange 160 of the body 152). Such modularity of the plenums reduces storage costs and requirements (i.e., substantially alleviates the need for different storage areas for different components due to only using a limited number of various arrangement plenums), eases manufacturing, increases manufacturing efficiency, and reduces a scrap rate.

It should be noted that references to "front," "rear," "upper," and "lower" in this description are merely used to identify the various elements as they are oriented in the figures. These terms are not meant to limit the element which they describe, as the various elements may be oriented differently in various temperature controlled cases.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the elements of refrigerated case 10 and the modular plenum 150 provided herein are illustrative only. Although only a few exemplary embodiments of the present inventions have been described in detail in this disclosure, those skilled in the art who review this disclosure will readily appreciate that many modifications are possible in these embodiments without materially departing from the novel teachings and advantages of the inventions. Accordingly, all such modifications are intended to be within the scope of the inventions.

What is claimed is:

1. A temperature controlled case having a housing defining a temperature-controlled space and a cooling element for selectively cooling the temperature-controlled space, the temperature controlled case comprising:

at least one modular plenum coupled to the housing and positioned behind the cooling element, wherein each of the at least one modular plenum includes:

a body;

a bracket coupled to the body;

a fan removably coupled to the bracket; and an electrical connector coupled to the body and positioned proximate the fan; and at least one air flow guidance device that guides an induced air flow from the cooling element to the fan;

wherein the body of each of the at least one modular plenum is coupled to the housing at an angle relative to a horizontal plane in use such that the fan is oriented at the angle or substantially at the angle in use, wherein the angle facilitates guidance of the induced air flow into a rear duct defined by the housing;

wherein each of the at least one modular plenum is removably coupled to the housing; and wherein each modular plenum of the at least one modular plenum is coupled to another modular plenum via a coupler plate.

2. The temperature controlled case of claim 1, wherein the coupler plate is also coupled to the cooling element.

3. The temperature controlled case of claim 1, wherein the modular plenum further includes a top flange coupled to the body and a bottom flange coupled to the body.

4. The temperature controlled case of claim 3, wherein the top flange interfaces with the cooling element to guide the induced air flow to the fan, wherein the bottom flange is coupled to the housing, and wherein the coupling of the bottom flange to the housing supports the body at an angle relative to a horizontal plane.

5. The temperature controlled case of claim 4, wherein the top flange, bottom flange, and body are of unitary construction.

6. The temperature controlled case of claim 1, wherein the bracket includes a first bracket and a second bracket positioned substantially parallel to the first bracket, wherein the fan slides into the first and second brackets for coupling the fan to the body via the first and second brackets.

7. The temperature controlled case of claim 1, wherein the at least one air flow guidance device includes:

a side panel coupled to at least one of the housing and the body, wherein the side panel is positioned in a volume defined by the body and a base wall of the housing; and a plate coupled to a rear wall of the housing and the body, wherein the plate extends over a top of the fan proximate the temperature-controlled space;

wherein the side panel and plate guide the induced air flow from the cooling element to the fan and into a duct defined by the housing.

* * * * *